US005285753A

United States Patent [19]

Duret et al.

[11] Patent Number: 5,285,753

[45] Date of Patent: Feb. 15, 1994

[54] TWO-STROKE ENGINE WITH SELECTIVE CONTROL OF THE CHARGE INTRODUCED IN THE COMBUSTION CHAMBER

[75] Inventors: Pierre Duret, Sartrouville; Gaetan Monnier, Rueil Malmaison; Thierry Colliou, Le Chesnay, all of France

[73] Assignee: Institut Francais Du Petrole, Rueil-Malmaison Cedex, France

[21] Appl. No.: 863,030

[22] Filed: Apr. 3, 1992

[30] Foreign Application Priority Data

Apr. 3, 1991 [FR] France ..... 91 04006

[51] Int. Cl.[5] ..... F02B 25/16

[52] U.S. Cl. ..... 123/65 V; 123/65 P

[58] Field of Search ..... 123/65 P, 65 V, 65 VC, 123/65 A, 80 BA, 65 R, 190.1

[56] References Cited

U.S. PATENT DOCUMENTS

| | | | |
|---|---|---|---|
| 2,110,754 | 3/1938 | Alston | 123/65 V |
| 2,113,979 | 4/1938 | Bokemuller | 123/65 V |
| 2,214,047 | 9/1940 | Dorwin et al. | 123/65 V |
| 2,440,726 | 5/1948 | Probst | 123/65 V |
| 2,473,164 | 6/1949 | McCoy | 123/65 V |
| 2,474,879 | 7/1949 | Winfield | 123/65 V |
| 2,675,789 | 4/1954 | Watkins et al. | 123/65 V |
| 2,797,672 | 7/1957 | Waterhouse et al. | 123/65 V |
| 4,995,354 | 2/1991 | Morikawa | 123/65 V |

FOREIGN PATENT DOCUMENTS

| | | | |
|---|---|---|---|
| 0400338 | 12/1990 | European Pat. Off. . | |
| 0404338 | 12/1990 | European Pat. Off. . | |
| 0460820 | 12/1991 | European Pat. Off. . | |
| 865233 | 7/1949 | Fed. Rep. of Germany . | |
| 932639 | 7/1949 | Fed. Rep. of Germany . | |
| 3933105 | 4/1990 | Fed. Rep. of Germany . | |
| 0101207 | 6/1983 | Japan | 123/65 P |
| 0035019 | 2/1987 | Japan | 123/65 P |
| 0309717 | 12/1988 | Japan | 123/65 P |

OTHER PUBLICATIONS

Abstracts of Japan, vol. 8 No. 20 (M-271) [1457] Jan. 27, 1984, Japanese Patent No. 58-178822.

*Primary Examiner*—David A. Okonsky

*Attorney, Agent, or Firm*—Antonelli, Terry, Stout & Kraus

[57] ABSTRACT

A two-stroke engine which includes a cylinder in which a piston moves with a device being provided for allowing the feeding of a charge under pressure to the cylinder and at least two inlet ports in a well of the cylinder. The engine includes a device for selectively sealing a section of flow of the inlet port in accordance with at least one working parameter of the engine The device for selectively sealing may, for example, include a rotary plug placed opposite the inlet ports, with the plug including at least two through openings.

12 Claims, 2 Drawing Sheets

TWO-STROKE ENGINE WITH SELECTIVE CONTROL OF THE CHARGE INTRODUCED IN THE COMBUSTION CHAMBER

BACKGROUND OF THE INVENTION

The invention relates to a two-stroke internal-combustion engine in which a selective control of the charge introduced in the combustion chamber through one or several inlet ports is achieved, in dependence upon the working conditions of the engine.

According to the invention, the inlet ducts are "throttled" differently with respect to each other in dependence upon to the working conditions of the engine.

The selective control of the introduction of the charge according to the invention is preferably achieved on two-stroke engines of the cross-scavenging type as defined hereafter.

The control can be applied in case the charge introduced contains no fuel, the fuel being then introduced through a separate inlet.

The pressure source used for the supply of air or of carbureted mixture in the cylinder can include a pressure source outside the engine such as a compressor, a blower or any other volume under pressure, or of an inner source such as the pump housing.

Two-stroke engines conventionally comprise at least one cylinder in the upper part thereof and a lower part, also called pump housing, in view of the main function thereof, which provides the introduction of fresh gases into the cylinder by one or more specific ducts known as "transfer ducts". Transfer ports or openings in the cylinder allow this introduction.

The piston which moves in a reciprocating manner in the cylinder provides the suction in the housing and the compression of the fresh gases in the cylinder. The fresh gases are generally introduced at the level of the pump housing through an opening, for example, provided with a check valve. The motion of the piston towards the upper part of the cylinder brings about the aspiration of fresh gases into the pump-housing; whereas, the opposite motion of the piston compresses these gases which, when the transfer ports are freed by the piston, are then injected under a given pressure into the cylinder, which generates therein a scavenging of fresh gases that drive waste gases away.

The waste gases can escape through openings known as exhaust openings provided in the cylinder, slightly offset in height with respect to the transfer ports. What is called "fresh gas" generaly relates to a mixture of air, carbureted or not.

One of the most serious problems with two-stroke engines supplied with a fuel-air mixture is that the intake of a subsequent cycle occurs at the same time as the exhaust of the previous cycle, so that a large part of the mixture fed to the cylinder directly goes back to the exhaust, without the combustion of the hydrocarbons.

The atmospheric pollution resulting from this phenomenon is considerable and is about 10 to 20 times as high as the pollution generated by a four-stroke engine. Also, the fuel consumptions is high and may, for example, be 50 to 100% greater than the fuel consumptions of a four-stroke engine.

Considerable research has been carried out in order to decrease the losses of unburned fuel through the exhaust.

The basic concept of most of the suggested improvements consists in delaying the introduction of the fuel which then occurs, for example, when the exhaust port is almost closed. But, if the introduction of the fuel is delayed, it will have to be introduced and vaporized within a very short time (about 2 to 3 milliseconds at high engine speed), which may pose problems.

In two-stroke engines of the "liquid direct fuel injection" type, the fresh gas charge contains no fuel. It can be compressed, either by an outer mechanical compressor, or by a compression source provided, for example, by the pump housing itself.

The fuel is then directly injected into the combustion chamber under high pressure, a pressure which is generally higher than 30 bars.

Another type of two-stroke engine capable of delaying the introduction of the fuel is based on the principle of the air-blast injection of the mixture. Compressed air is used in this case for allowing to spray and to vaporize very rapidly the fuel in the cylinder.

There are several ways of achieving the source of pressure. For example, U.S. Pat. No. 4,693,224 shows the use of a specific compression chamber intended to contain a given amount of fuel under pressure and to inject this mixture into the combustion chamber.

In a different way, French patent application FR-2,496,7571 proposes an air-blast injection of fuel in the cylinder by using the pressure of the fresh gases inside the pump housing. A means for proportioning the liquid fuel is therefore directly linked to the transfer duct coming from the pump housing. The air compressed in the pump housing and sent towards the proportioning means through at least one specific duct provides in this case the spraying of the fuel within a very short time. The fuel droplets, very thin, are immediately vaporized into the combustion chamber.

The result of all that has been written so far is that the way the charge is introduced and then directed in the combustion chamber of a two-stroke engine is very important, and must therefore be achieved in an optimum way, with a control as rigorous as possible. In other words, the engine efficiency depends to a large extent on the spraying and the injection of the fuel into the cylinder and on the internal aerodynamics responsible for the mixing of this fuel with the fresh air.

In FR-2,649,157 one or more parts for restricting the flow of the fresh gases allowed to pass into the cylinder are provided inside the transfer duct(s) and close to the cylinder.

SUMMARY OF THE INVENTION

The object of the present invention is notably to improve this type of control means since it relates to an engine of the cross-scavenging type, comprising a cylinder in which a piston moves, a means allowing to feed a charge under pressure to the cylinder and at least two inlet ports in with the wall of the cylinder, said ports co-operating with the charge intake means. According to the invention, the engine comprises a means intended to selectively obturate the section of flow of the means allowing to feed the charge to the combustion chamber, according to at least one working parameter of the engine.

The advantage of such a device lies in a better control of the internal aerodynamics of the engine cylinder.

This means may, for example, consist of a part moving in rotation around an axis substantially perpendicular to the axis of the cylinder and provided with at least one extension.

The means for selectively sealing the section of flow may also includes, without departing from the scope of the invention, of a rotary plug comprising several through openings, with the plug being placed opposite the inlet port(s) in the cylinder.

According to an embodiment procedure of the invention, the rotary plug may for example, be provided with four through openings of different section two by two.

Without departing from the scope of the invention, the rotary plug can comprise three through openings not faraway from one another.

The introduced charge may contain fuel or not.

The pressure source may include the pump housing or of a pressure source outside the engine such as a compressor or any other well-known means.

The different features mentioned above enable a creation of a perfectly controlled aerodynamic movement inside the cylinder, according to one or several working parameters of the engine, and particularly according to the speed and the load of the engine.

BRIEF DESCRIPTION OF THE DRAWINGS

Other features and advantages of the invention will be clear from reading the description hereafter, given by way of illustrative and non limitative example, with reference to the accompanying drawings wherein.

DESCRIPTION OF THE PREFERRED EMBODIMENTS

Figure 1:
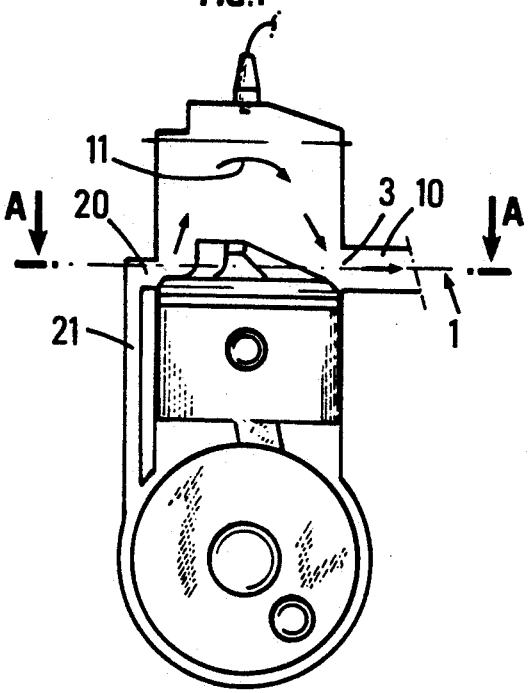
FIG. 1 is a longitudinal cutaway view of a conventional cross-scavenging two-stroke engine fed through the pressure of the pump housing.

The present invention preferably relates to two-stroke engines known as "cross-scavenging engines". FIG. 1 shows a conventional embodiment example of such an engine. The scavenging is called cross-scavenging since the inlet port(s) 20 are placed together on a single side of the cylinder with the total number of exhaust openings 3 being grouped together on the other side of the cylinder, and these two groups of openings being arranged on either side of an axial plane of symmetry of the cylinder in substantially symmetric positions.

The scavenging gas which, in the case of the engine in FIG. 1, comes from the pump housing, but which can also come from another pressure source, thus describes a movement approximately defined by arrows 11.

Figure 2:
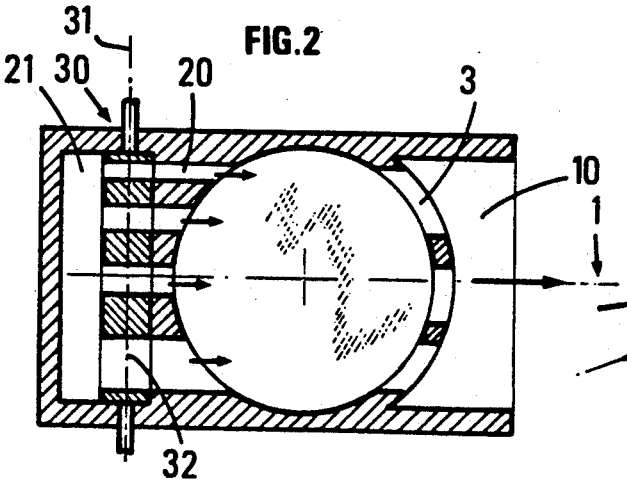
FIG. 2 is a cross-section along A—A of FIG. 1 of a two-stroke engine according to the invention.

As shown in FIG. 2, according to the invention, a selective obturating means 30 is placed in the inlet duct 21 of the cylinder.

This means 30 can have the shape of a rotary plug with an axis 31 perpendicular to the axis 1 of the exhaust duct. Plug 30 is provided with at least one through opening 32 whose shape and/or arrangement correspond to the planned application.

Figure 3:
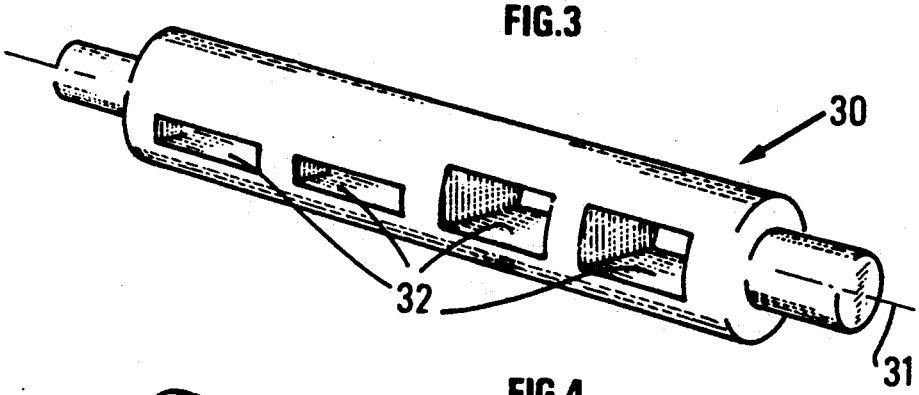
FIGS. 3 and 4 show several embodiment of a rotary plug according to the invention.
Figure 4:
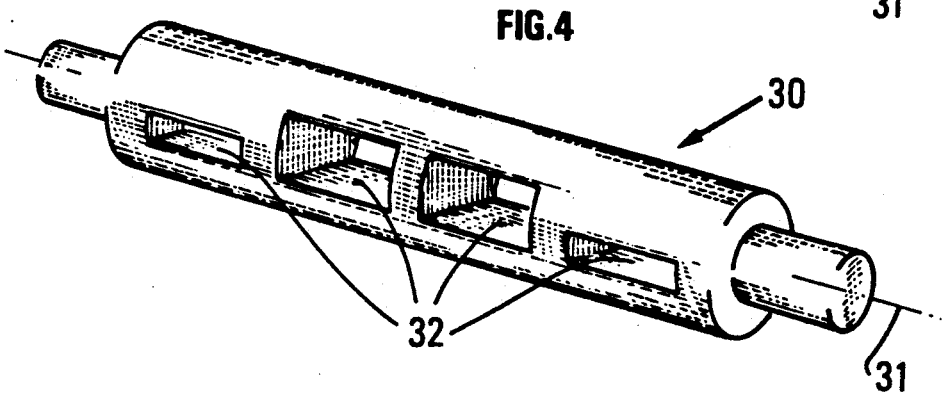

Plug 30 can thus be provided with through openings 32 such as those shown in FIGS. 3 and 4.

In FIG. 3, two openings of large section are arranged in a single half of the plug whereas two openings of smaller section are located in the other half of the plug.

This configuration produces a whirling movement of the gases in the combustion chamber. This whirling movement, unsymmetrical with respect to the axial plane of symmetry of the cylinder, can be interesting with direct fuel injection engines. As a matter of fact, this substantially helical movement may assist in mixing and vaporizing the liquid fuel directly introduced into the combustion chamber, generating thereby improved combustion conditions.

FIG. 4 shows another example of a rotary plug 30 particularly adapted to cross-scavenging engines. In fact, the plug 30, as shown in FIG. 4 is provided with large through openings arranged in the central part, and with smaller openings placed on the periphery, on either side of the central openings. This layout permits, when the allowed flow rate is low, to better center the intake gases around the axis of the exhaust duct on which the ignition plug is generally located. This is obtained by obturating first the peripheral inlet ducts before those located in the central part. The low charge flow rate is therefore used in an optimum way as for the scavenging of the combustion zone.

In all the cases considered above, the flow of the gases passing through the plug, i.e. the gases which are going to enter the combustion chamber, is regulated for example according to the load of the engine, to the engine speed or to any other working parameter of the engine. The rotating of plug 30 around the axis 31 thereof can in fact vary the flow of the gases allowed to pass. Thus, with a plug 30 such as shown in FIG. 4, a certain rotation can prevent any flow in the lateral openings and force all the gases to pass through the central openings.

In the cross-scavenging engines defined above, the charge can of course be set under pressure through the pump housing or by any other means. Besides, it may be advantageous to have a means intended to reduce the angular aperture time of the inlet duct(s), in combination with the selective section reduction.

Figure 5:
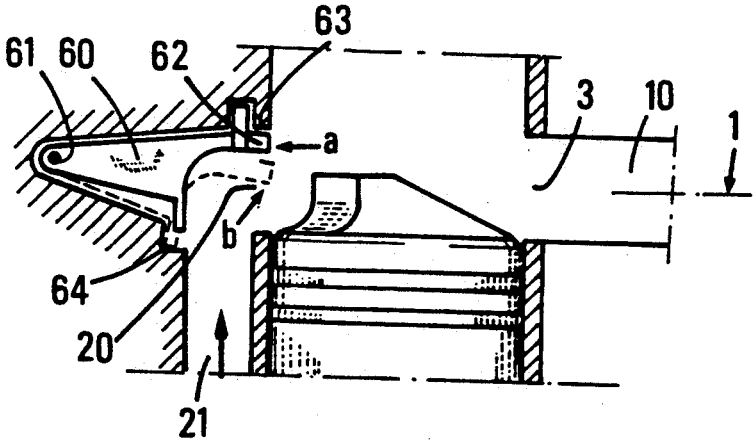
FIG. 5 is a partial longitudinal section of an engine according to the invention, equipped with an additional system for controlling the section and the angular aperture time.

This means 60, as shown in FIG. 5, is rotatable around an axis 61 which may be perpendicular to the axis 1 of the exhaust duct and which belongs to a straight section of inlet duct 21. Means 60 is located close to inlet port 20 and is provided with as many extensions 62 as there are ports or divisions in the inlet port. Each extension 62 covers in fact more or less partially inlet port 20 according to the angle of rotation of means 60 around axis 61. The rotation is preferably limited by two thrusts, one thrust 63 being for example defined by the upper part of port 20, and the other thrust 64 can be defined by the cylinder block itself. The position (a) in which means 60 uncovers most port 20 is shown in full line in FIG. 6, whereas the dotted line shows means 60 in the maximum covering position (b) thereof.

Means 60, by changing the actual cross-section of port 20, enabling a varying of the aperture time of the inlet duct(s). Moreover, by differently altering or modifying each port (or each port division), a certain aerodynamics of the gases within the combustion chamber are generated.

Figure 6:
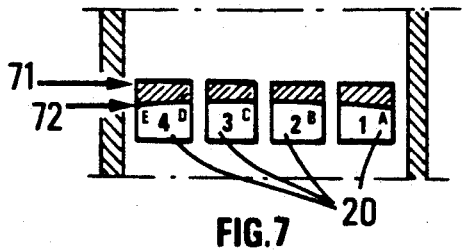
FIG. 6 is a longitudinal section along an axis perpendicular to the axis of the section in FIG. 5 showing a front view of the additional control system.

FIG. 6 shows, by a cross-section perpendicular to the previous one, the aperture variations of inlet port 20, where the "higher" position (a) of means 60 corresponds to line 71; whereas, the "lower" position (b) of means 60 is defined by curve 72. It appears that, in the "lower" position (b), the closing time is not identical at all points of transfer port(s) 20. The points which are the most distant from the axis of the inlet duct, A and E for example, cover port 20 more than points B, C and D which are the closest to the axis. This difference is due to the fact that the radius of displacement of the points is different. Means 60 therefore allows a selective reduction of the section in combination with the reduction of the angular aperture time.

According to another embodiment of the invention, whose operating is explained in connection with FIGS. 7, 8 and 9, an equivalent sealing means can be used in case inlet duct 21 is divided at the level of inlet port 20 into three parts placed for example non-symmetrically in relation to the axial plane of symmetry of the cylinder containing exhaust axis 1.

Figure 7:
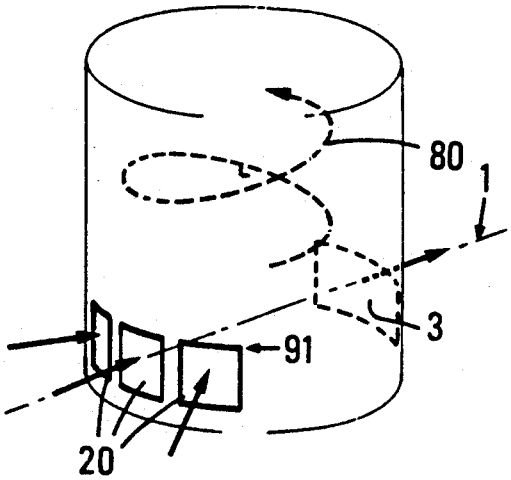
FIG. 7 is a simplified perspective showing the movement of the gases inside a combustion chamber according to another embodiment of the invention, at the time of the maximum opening of the ports.

This layout of ports 20 generates an unsymmetrical movement, for example helical, of the gases such as shown by arrows 80 in FIG. 7 when means 60 is in the higher position, i.e. for the total opening of ports 20.

As mentioned above, this movement is very favorable in case of a direct injection of fuel in the liquid state into the combustion chamber, especially with high charges which generally correspond to the totally open position.

Figure 8:
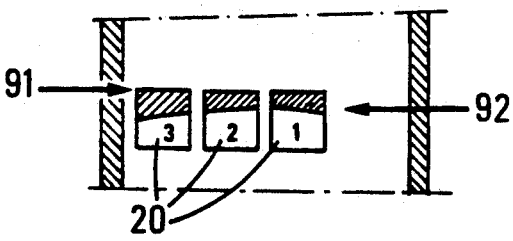
FIG. 8 is a cross-section identical to the one of FIG. 6, showing another embodiment procedure of the additional control system according to the invention.

This movement can yet be made more symmetrical when means 60 is in the maximum covering position (curve 92 in FIG. 8). In fact, in this "lower" position of means 60, peripheral port 20 is almost covered, so that only the two ports located on either side of the axis of symmetry 1 allow the charge to enter significantly the combustion chamber. These two ports will be preferably obturated (through means 60 in the same way, whatever the position of means 60 may be.

Figure 9:
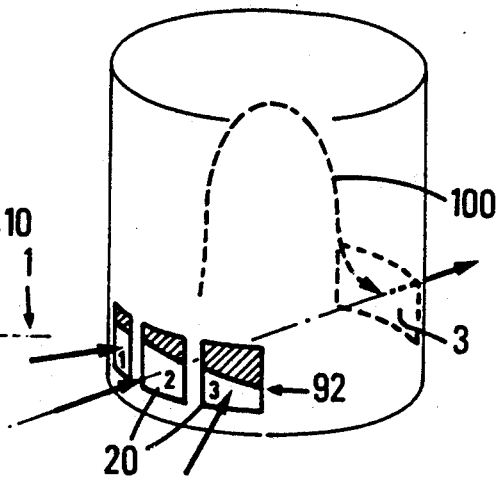
FIG. 9 is a simplified perspective identical to the one of FIG. 8, but at the time of the maximum obturation of the inlet ports.

FIG. 9 shows with arrow 100 the movement of the gases inside the combustion zone when the obturating means 60 are in the lower position. A symmetrization of the scavenging is obtained thereby.

A lower position of the extensions with a low charge will be preferably selected, whereas, the higher position of complete opening will correspond to a high-charge adjustment.

As readily apparent, the profile of part 60 is very important for the angular aperture time as well as for the internal aerodynamics of the gases in the combustion chamber.

Any well-known means can be used for controlling the rotation of means 60 according to at least one working parameter of the engine.

As in the case of loop-scavenging engines, the pressure source may include the pump housing or of any other means.

While we have shown and described several embodiments in accordance with the present invention, it is understood that the same is not limited thereto but is susceptible to numerous changes and modifications as known to one of ordinary skill in the art and we therefore do not wish to be limited to the details described hereinabove but intend to cover all such modifications as are encompassed by the scope of the appended claims.

We claim:

1. A two-stroke engine of a cross-scavenging type comprising a cylinder in which a piston moves, a means for allowing a charge under pressure to be fed to said cylinder, at least two inlet ports in a wall of said cylinder, said at least two inlet ports cooperating with said means for feeding the charge, and means for selectively sealing in a differentiated manner sections of flow of said at least two inlet ports in dependence upon at least one working parameter of the engine.

2. A two-stroke engine as claimed in claim 1, wherein the means for selectively sealing includes at least one rotary obturating element comprising at least two through openings, said at least one rotary obturating element being placed in opposition to said at least two inlet ports.

3. A two-stroke engine as claimed in claim 2, wherein the rotary obturating element comprises two pairs of through openings, with each pair of openings having a different section.

4. A two-stroke engine as claimed in claim 3, wherein the pair of openings of a larger section are located adjacent to each other.

5. A two-stroke engine as claimed in claim 4, wherein the pair of openings of the larger section are located in a central part of the rotary obturating element.

6. A two-stroke engine as claimed in claim 2, wherein the rotary obturating element comprises three openings arranged in close proximity to each other and disposed in a non-symmetrical relationship to an axis of symmetry of exhaust of the gases.

7. A two-stroke engine as claimed in claim 1, wherein the means for selectively sealing includes at least one pivotable part moving around an axis of a straight section of a duct for feeding the charge, said pivotable part being provided with at least one extension located near to at least one of the inlet ports, and wherein a pivotable movement of said at least one pivotable part enables a modification of an angular aperture time of the ports and different obturating at said at least two inlet ports in dependence upon at least one working parameter of the engine.

8. A two-stroke engine as claimed in claim 7, wherein said at least one rotatable part is rotatable between two positions, with each position achieving a given aerodynamics of the charge in a combustion chamber of the two-stroke engine.

9. A two-stroke engine as claimed in one of the claims 1, 2, 3, 4, 7 or 8, wherein the charge contains a fuel.

10. A two-stroke engine as claimed in one of claims 1, 2, 3, 4, 7 or 8, wherein the charge essentially consists of air.

11. A two-stroke engine as claimed in one of claims 1, 2, 3, 4, 7 or 8, further comprising a pump housing for forming a feed source for producing a pressure to the charge.

12. A two-stroke engine as claimed in one of claims 1, 2, 3, 4, 7 or 8, further comprising an external means for forming a feed source for providing a pressure to the charge.

* * * * *